United States Patent [19]

Kaufman et al.

[11] 4,151,382

[45] Apr. 24, 1979

[54] SWITCH ASSEMBLY FOR ALARM SYSTEMS

[76] Inventors: Edward Kaufman, 41-27 W. Moreland St., Little Neck, N.Y. 11363; Frank Picciotto, 667 River Vale Rd., River Vale, N.Y. 07675; Jack Beck, 33 Feller Dr., Central Islip, N.Y. 11722

[21] Appl. No.: 848,156

[22] Filed: Nov. 3, 1977

[51] Int. Cl.[2] ..... H01H 3/00

[52] U.S. Cl. ..... 200/61.71; 200/61.74; 200/61.81; 200/61.93

[58] Field of Search ..... 200/61.62, 61.71–61.76, 200/61.8, 61.81, 61.93

[56] References Cited

U.S. PATENT DOCUMENTS

| | | | |
|---|---|---|---|
| 3,569,645 | 3/1971 | Lea | 200/61.93 X |
| 3,748,416 | 7/1973 | Wechter | 200/61.74 |
| 3,775,575 | 11/1973 | Parlato et al. | 200/61.71 |

*Primary Examiner*—James R. Scott

[57] ABSTRACT

A switch assembly utilized for interconnecting foil conductors on a window or the like with a burglar alarm system. The switch assembly comprising a first switch unit adapted to be mounted on a movable window or the like, with a second switch unit adapted to be mounted on a fixed surface adjacent to the movable window. The first switch unit includes a slot with first contacting means including a pair of spring biased slidable contact elements insulated from one another and extending through the slot. The contact elements each have a fixed end and a free end. Coupling means for permitting removable positional securement of the conducting elements between each one of the fixed ends and the foil conductors is provided. The second switch unit comprises a second housing having second contacting means fixedly secured to the second housing and comprising a pair of contact members insulated from one another for engagement with the first contacting means. Connecting means to electrically couple the second contacting means with the burglar alarm system is provided.

35 Claims, 4 Drawing Figures

SWITCH ASSEMBLY FOR ALARM SYSTEMS

BACKGROUND OF THE INVENTION

The present invention pertains to burglar alarm systems in general and more particularly, to a new and novel switch assembly for use in connection with foil conductors.

DESCRIPTION OF THE PRIOR ART

The present invention improves upon the prior art devices that utilize a two-part switch structure for use in connection with window foil conductors. It has been appreciated, in the prior art, that the utilization of a two-part switch structure may be utilized in conjunction with windows having foil conductors, in order to permit the windows to be conveniently opened for ventilation or cleaning, or the like, when the burglar alarm system is deactivated. Examples of these types of devices are contained in the disclosures set forth in U.S. Pat. Nos. 3,748,416 and 3,775,575.

It has now been discovered that the structure of these devices limits their application and utilization in a manner that does not always provide the desired end results. The advantages and distinctions of the present invention over the prior art will become clearly evident hereinafter.

OBJECTS OF THE PRESENT INVENTION

It is the primary object of the present invention to provide a switch assembly mountable on double hung windows, or the like, for use in an alarm circuit to actuate the alarm circuit upon unauthorized opening of either window.

It is another object of the present invention to provide a switch assembly which may be readily mounted and installed to form part of a burglar alarm system, and yet permit minimal opening or movement of a window or the like, without actuating the alarm system.

It is still another object of the present invention to provide a switch assembly consisting of a first switch unit and a second switch unit having large surface areas for physical engagement in order to provide electrical continuity in the system so that closed conductive circuit paths are assured.

SUMMARY OF THE INVENTION

The switch assembly of the present invention is utilized for interconnecting foil conductors on a window or the like with a burglar alarm system. The switch assembly comprises a first switch unit adapted to be mounted on a movable window or the like with a second switch unit adapted to be mounted on a fixed surface adjacent to the movable window.

The first switch unit comprises a first housing having oppositely disposed sides and spaced apart surfaces intermediate the sides, as well as a first housing having a slot extending between the oppositely disposed surfaces intermediate the sides. First contact means is provided comprising a pair of spring biased slidable contact elements insulated from one another and extending through at oppositely disposed ends of the slot. The contact elements each have a fixed end and a free end. Coupling means for permitting removable positional securement of the conducting elements between each one of the fixed ends and foil conductors is provided. The second switch unit comprises a second housing having second contact means fixedly secured to the second housing and comprising a pair of contact members insulated from one another.

Connecting means is provided to electrically couple the second contact means with the burglar alarm system. The first and second contact means are constructed to permit mutual engagement in order to form a continuous circuit from the foil conductors to the burglar alarm system so that movement of the window, such as opening, or the like, changes the relative position of the free ends of the contact elements relative to the contact members to activate the burglar alarm system, yet permitting minimal movement without activating the alarm.

The first housing includes a longitudinally extending upper groove on one of the surfaces intermediate the sides thereof, and the fixed end of each one of the contact elements is adapted to extend within the upper groove and below the surface adjacent thereto. The first housing terminates in oppositely disposed ends, with the slot extending substantially centrally between the oppositely disposed ends of the first housing. The upper groove is disposed substantially equidistantly on each side of the slot.

BRIEF DESCRIPTION OF THE DRAWINGS

The foregoing and other objects, features and advantages of the present invention will become readily apparent to those skilled in the art from the following discussion of the detailed description hereinafter, considered in conjunction with the accompanying drawings, wherein FIG. 1 schematically illustrates a typical window containing foil strips in which the novel switch assembly of the present invention may be mounted at one or both ends of the window.

DESCRIPTION OF THE PREFERRED EMBODIMENT

Figure 1:
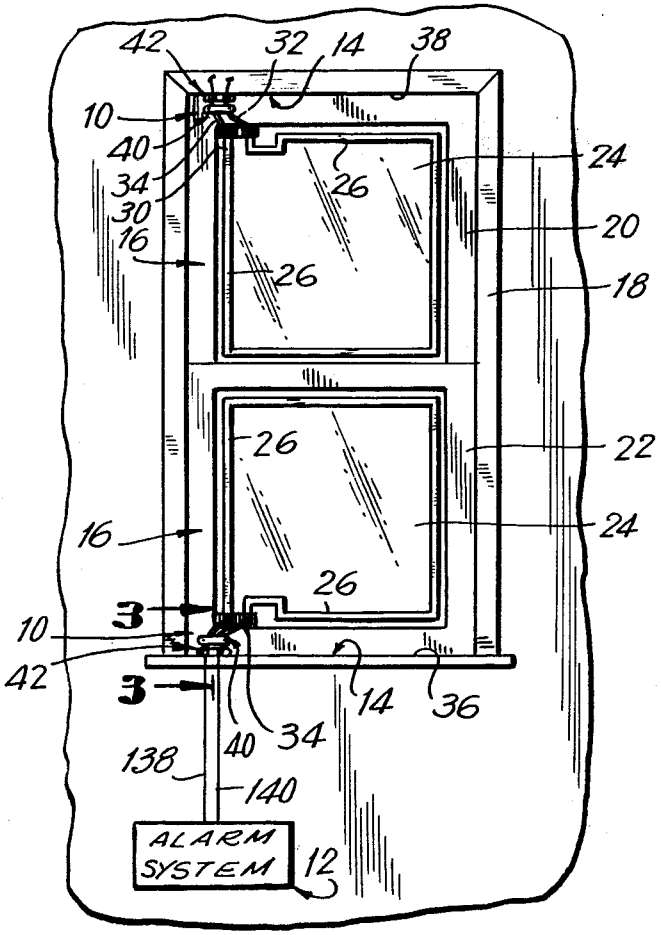

FIGS. 1 through 4 illustrate a preferred embodiment of the present invention for a switch assembly which is generally denoted by the reference numeral 10. The switch assembly 10 is utilized in conjunction with a burglar alarm system 12 of a design and type well known in the art and which is presently in use today, and may be utilized in conjunction with a generally fixed surface 14 and a movable surface or member 16. The movable member 16, as illustrated in FIG. 1, may comprise a window having a main frame 18 and upper and lower movable portions 20 and 22, respectively. Each of the movable portions 20 and 22 contains a glass pane 24. Each glass pane 24 may be provided with conventional conductive foils 26 which normally function to define a continuous electrical circuit which can produce a burglar alarm type of signal if the foil 26 is interrupted due to breakage or entry through the window pane 24 that would interrupt the foil conductor.

Figure 2:
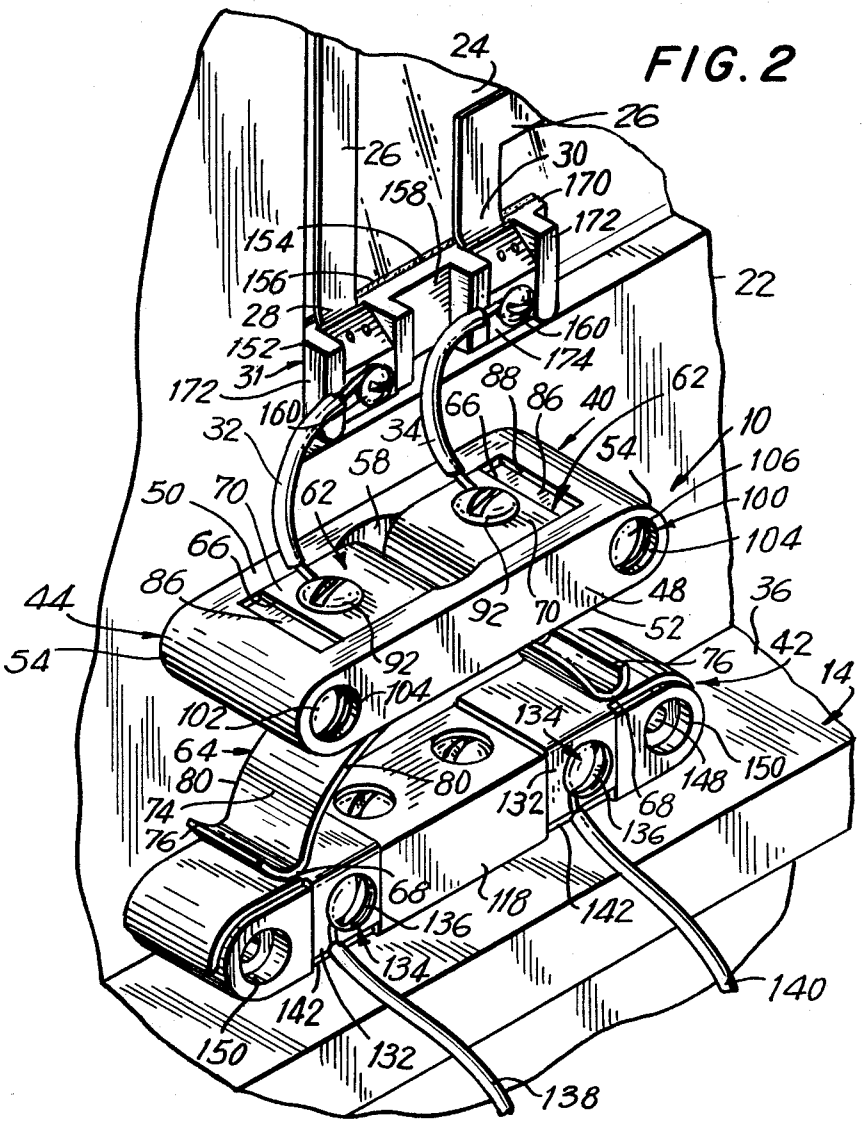
FIG. 2 is an enlarged perspective view illustrating the mounted relationship of the novel switch assembly of the present invention.

The foils 26 in FIGS. 1 and 2 are shown with interruptions 28 and 30 which are respectively connected by conducting elements 32 and 34 in a continuous circuit through the foil of the protected window 24 and the switch assembly 10 of the present invention, which will hereinafter be described in greater detail.

A terminal or foil block assembly 31 may be mounted on the glass pane 24 to provide for the electrical interconnection between the conductive foils 26 and the conducting elements 32 and 34. The structure of the foil block assembly 31 is hereinafter described in detail.

The movable member 16, although illustrated to be in the form of a window, may also be a sliding door such as is found on a patio, or other movable member to which a burglar alarm is normally connected. Similarly, the fixed surface 14 may be in the form of a window sill 36 or the upper end 38 of the main frame 18. It is to be appreciated that the switch assembly 10 is ideally suited for mounting and utilization in a horizontally mounted plane, as illustrated in the drawings; however, the assembly 10 may also be vertically mounted, if desired. This is most important in that it permits the user of the switch assembly 10 to select the ideal positioning of the switch assembly 10 in conjunction with the burglar alarm system 12. Accordingly, in the mounting arrangement illustrated, the upper portion 20 and lower portion 22 are each movable independently of each other and movement thereof beyond certain distances will automatically cause a breakage in the continuous circuit such that the burglar alarm circuit becomes energized in order to create a burglar alarm type signal which may be either audible or visual.

The switch assembly 10 for interconnecting window foil conductors 26 includes a first switch unit or assembly 40 and a second switch unit or assembly 42. The first switch unit 40 includes a first housing 44 having oppositely disposed sides 46 and 48, with side 46 being the inner side adapted to engage the movable portion 22 and the side 48 being the outer side. The first housing 44 includes spaced apart surfaces, being defined as the upper surface 50 and the lower surface 52. The first housing 44 terminates in oppositely disposed ends 54 which merge with the sides 46 and 48 and the surfaces 50 and 52.

The first housing 44 is elongated in configuration so that it may be readily and conveniently mounted in selective position. The sides 46 and 48, as well as the surfaces 50 and 52, may extend in substantially parallel spaced relationship to each other. The first housing 44 also includes a slot 56 extending substantially vertically between the spaced apart surfaces 50 and 52. The slot 56 may be defined by a pair of side walls 58 and a pair of end walls 60. The end walls 60 extend transversely between the sides 46 and 48. The side walls 58 may have an arcuate configuration.

Figure 4:
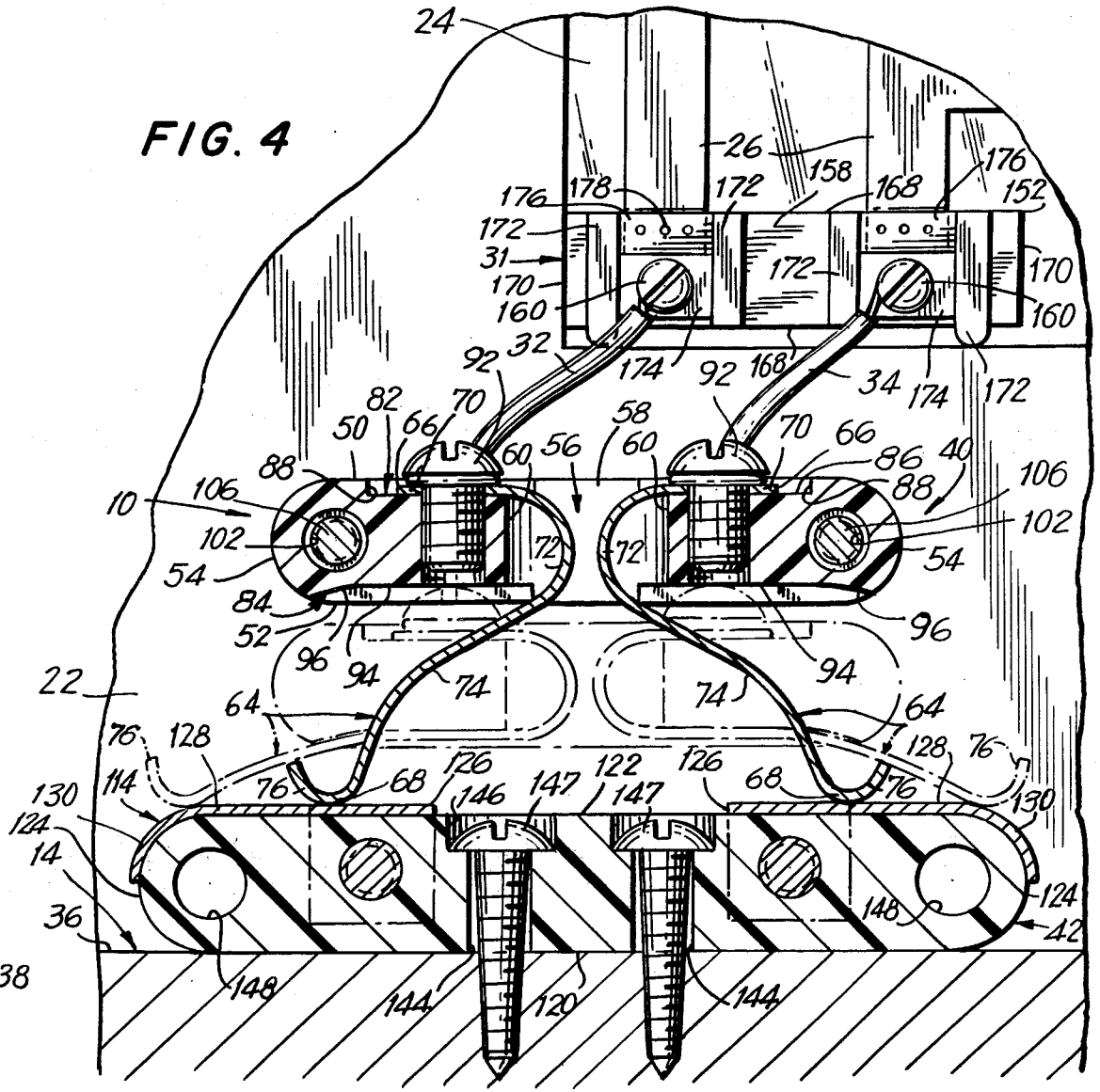
FIG. 4 is a vertical sectional view taken on line 4—4 of FIG. 3.

To provide the electrical connection between the foil conductors 26, first contact means 62 associated with the first housing 44 is provided. The housing 44 is fabricated from an insulated plastic material to prevent short circuiting between the pair of spring biased slidable contact elements 64 which form the first contact means 62. The contact elements 64 each have a predetermined contoured configuration to permit movement from their position as illustrated in FIG. 4. The movement may be between a retracted position and an extended or protracted position, as illustrated in phantom in FIG. 4. Each of the contact elements 64 includes a fixed end 66 and a free end 68 disposed in spaced relationship with respect to one another.

To permit the requisite amount of movement of the first switch unit 40 relative to the second switch unit 42, each contact element 64 includes a horizontally extending upper section 70 forming the fixed end 66. An arcuate or curved section 72 is integrally formed with the upper section 70 at one end thereof and extends through the slot 56 (as illustrated in FIG. 4), and an integrally formed lower contoured portion 74 extends rearwardly from the arcuate section 72.

Figure 3:
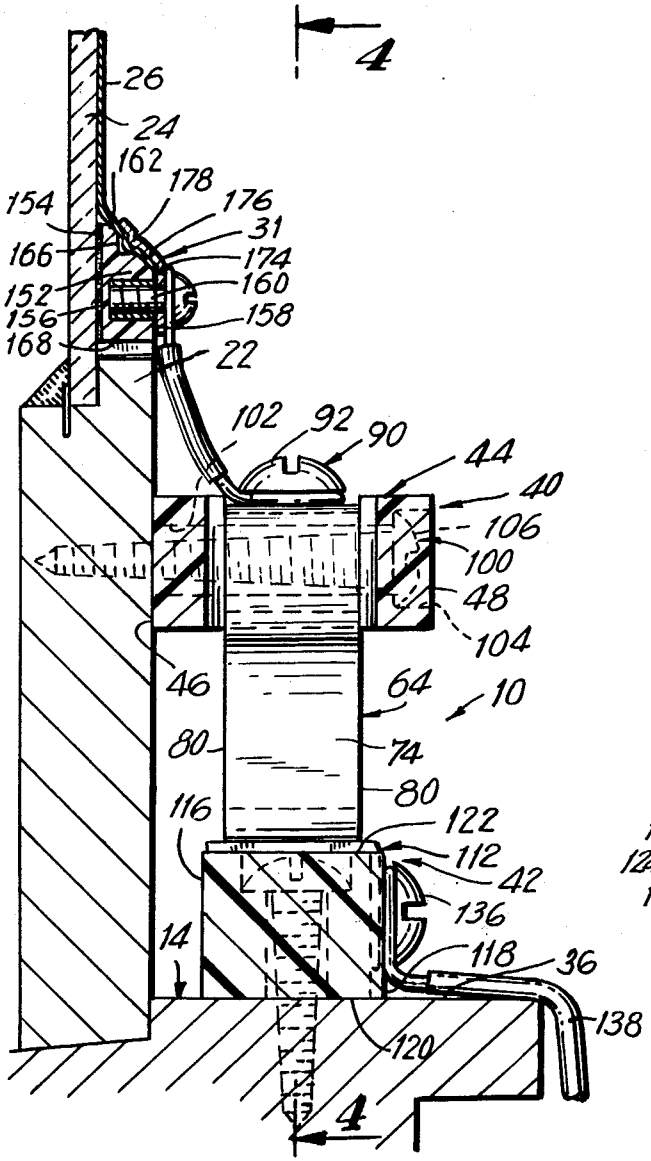
FIG. 3 is a vertical sectional view taken on line 3—3 of FIG. 1.

The contact element 64 may also have an upturned end portion or lip 75 integrally formed with the lower contoured portion 74 to thereby form the curved contact portion or free end 68 to the contact element 64. The width of the contact element 64, in particular, in the arcuate section 72, may be substantially equal to the side walls 58. The arcuate section 72 defines an arc substantially equal to the spaced between the surfaces 50 and 52. Further, the contact elements 64 are mounted in oppositely disposed directions with respect to one another and may have the oppositely disposed edges 80 thereof extending in parallel spaced relationship, as illustrated in FIG. 3.

The contact elements 64 are preferably fabricated from an electrically conductive metallic material such as phosphor bronze or the like. The metallic material is selected so as to provide the desired degree of resiliency in the lower contoured portions 74 for movement between the extended and retracted positions, as illustrated in FIG. 4, and for its excellent electrical conductivity properties.

The first housing 44 further includes a longitudinally extending upper groove 82 formed in the upper surface 50 and a longitudinally extending lower groove 84 formed in the lower surface 52. The respective grooves 82 and 84 may extend outwardly from the slot 56 and may be either partially or continuously extensive with the full length of the first housing 44. In the preferred embodiment of the present invention, the upper groove 82 has a seat 86 that extends below the upper surface 50, a distance at least equal to the thickness of the contact element 64. The slot 82 is defined at each end thereof by an exterior wall 88. The exterior walls 88 may extend in a plane substantially normal to the sides 46 and 48.

In this manner the upper section 70 is adapted to be contained within the seat 86 and the slot 82 may extend substantially centrally between the oppositely disposed ends 54. Further, the upper groove 82 may extend substantially equidistantly on each side of the slot 56. There is further provided coupling means 90 for permitting removable positional securement of the conducting elements 32 and 34 between each one of the fixed ends 66 and the window foil conductors 26.

The coupling means 90 in the preferred embodiment of the present invention may be in the form of fasteners 92, such as screws. A fastener 92 is associated with each of the contact elements 64 for retaining each one of the fixed ends 66 and the conducting elements 32 and 34 in fixed positions relative to the upper surface 50. As illustrated, the conducting elements 32 and 34 may be in the form of an insulated coated wire having one of the ends stripped and connected between the head of screw 92 and its respective contact element 64. In this manner, the coupling means 90 performs a dual function in that they are threadably received in the first housing 44. Thus, the coupling means 90 concomitantly retains one of the ends of the conducting elements 32 and 34 in fixedly secured position and, at the same time, secures the fixed ends 66 to the respective contact elements 64. This provides for a minimal number of parts and provides relative ease in maintenance and assembly, which may be required from time to time. In this manner, the screws 92 serve the dual function of retaining the contact elements 64 in place, and also providing a direct electrical connection to the foil 26 by means of the conducting elements 32 and 34. The depth of the longitudinally extending and vertically disposed upper groove 82 is preferably selected so that the upper section 70 extends below the upper surface 50. The lower groove 84 is formed having a seat 94, as illustrated in FIG. 4, and is disposed above the lower surface 52. The seat 94 may be formed having a contoured exterior wall 96 at each end of the lower groove 84 so as to enable the contoured portion 74 to abut thereagainst when the contact elements are in their protracted position, illustrated in phantom in FIG. 4.

The length and configuration of the contact elements 64 permits for the vertical mounting of the switch assemblies 40 and 42 so that the electrical contact therebetween is maintained notwithstanding the fact that the upper portion 20 or lower portion 22 is moved a slight distance by the occupant of the building. This structure is desirable in order to permit the occupant of a building to leave the window slightly open for air circulation, while still maintaining the alarm system 12 in its activated and ready state.

First mounting means 100 is provided with the first switch unit 40. The first mounting means 100 may take the form of a pair of apertures 102 extending between the oppositely disposed sides 46 and 48 of the first housing 44. A counterbore or recess 104 may be provided at one end of each aperture 102 at the outer side 48. This permits screw 106 to be contained within the aperture 102 with its head recessed in counterbore 104.

In the manner described hereinabove, by utilization of the first mounting means 100, the first switch unit 40 may easily be secured in place with respect to one of the movable portions 20 and 22 of a window frame 18, or the like. There is also provided second mounting means 110 utilized for securing the second switch unit 42 to a fixed surface 14 which may be in the form of a window sill 36.

The second switch unit 42 comprises a second housing 112 that is formed from an insulative plastic material to prevent short circuiting of the second contact means 114 (members 126) fixedly secured to the second housing 112. The configuration of the second housing 112 is such that it includes oppositely disposed sides 116 and 118 that may extend in spaced parallel relationship to each other. As illustrated in FIG. 3, the width or distance between the sides 46 and 48 of the first housing 44 may be greater than the distance between the sides 116 and 118 of the second housing 112. The second housing 112 further includes spaced apart surfaces 120 and 122 intermediate the sides 116 and 118. Surface 120 is the bottom or lower surface adapted to abut the window sill 36. Surface 122 is the upper surface and is disposed in vertically spaced relationship with respect to the lower surface 52 of first housing 44. Surfaces 120 and 122 may extend in spaced parallel relationship to each other. The second housing 112 terminates in oppositely disposed ends 124.

The configuration of the elongated second housing 112 may have each of its respective ends 124 having a circular configuration, as illustrated in FIG. 4. The respective ends 54 of the first housing 44 may similarly have circular ends. The second contact means 114 includes a pair of contact members 126 that are fixedly secured to the upper surface 122 of the second housing 112 so that they extend in partially overlapping relationship thereto and in operative relationship to the free ends 68 of the respective contact elements 64.

Accordingly, each contact member 126 includes a contact portion 128 that extends in a plane substantially parallel to the free end 68 of each contact element 64. Each contact member 126 further includes a contoured outer end 130 adapted to partially circumscribe the free end 124 of the second housing 112. In this manner, extended coupling of the contact elements 64 is obtained in the protracted position, as illustrated in phantom in FIG. 4. This is important since it permits the degree of movement of the movable portions 20 and 22 if a slight opening, for whatever reason, is desired. Further, a minimal movement due to vibration or other occurrences would not cause a disengagement between the contact elements 64 and the contact members 126, so as to prematurely activate the burglar alarm 12. Each contact member 126 further includes a downwardly extending contact leg 132 which may have an opening therethrough in order to provide securement to the second housing 112. The contact elements 64 and the contact members 126 are respectively mounted in longitudinal alignment with each other, so that the free ends 68 may move along the contact members 126 freely and maintain electrical contact at all times.

Connecting means 134 is provided to secure each of the contact members 126 in the position illustrated in FIGS. 2 through 4. The connecting means 134 may include a threaded fastener 136 associated with each contact leg 132. The fastener 136 not only secures the contact leg 132 in place, but also secures the respective electrical leads 138 and 140, which in turn are connected to the burglar alarm system 12. In this manner, the screws 136, which may extend in a threaded aperture, serve the dual function of maintaining the electrical continuity and retaining the contact members 126 secured in place. A vertically extending pair of slots 142 may be provided on the side 118 in order to receive the contact leg 132 so that the same is substantially flush with the side 118.

The second mounting means 110 is preferably provided so as to permit mounting of the second switch unit 42 either upon window sill 36 or against surface 121. Accordingly, there is provided a first pair of second mounting apertures 114, as illustrated in FIG. 4, having a counterbore 146 extending lower than surface 122. The apertures 144 extend between surfaces 120 and 122 to permit mounting of the second switch unit 42 in the manner illustrated herein. A second pair of mounting apertures 148 is provided and extend transversely between the opposing sides 116 and 118. The apertures 148 have counterbores 150 provided on surface 118. In this manner the surface against which the second switch unit 142 is mounted is optional to the person installing the switch assembly 10. A screw 147 extends through each of the apertures 144, as illustrated, for securement of the second switch unit 42 to the fixed surface 14 (window sill 36).

In the manner described hereinbefore, the installation of the switch assembly 10 is performed in a manner so that the first contact means 62 and second contact means 114 are constructed to engage each other so as to form a continuous electrical circuit path from the window foil 26 to the burglar alarm system 12 via the conducting elements 32 and 34, the first switch unit 40, the second switch unit 42 and the leads 138 and 140. Accordingly, separation of the contact elements 64 from engagement with the contact members 126 will effectuate a break in the electrical circuit path and activate the burglar alarm system 12.

It will be appreciated that the structure of the present invention is such that the upturned end portions 76 provide the necessary rigidity and are able to make very secure and extensive electrical contact with the conducting members 126. This is important to prevent inadvertent activation of the alarm circuit. Further, the width of the contact elements 64 is substantially equal to the contact portion 128 of the contact member 126, thereby always assuring a good, sufficient and proper electrical contact between the two units of the switch assembly 10. This is most important in that the apparatus of the present invention may not be used for prolonged periods of time and yet electrical contact must always be maintained in order to provide assurance that at the time of use, the assembly 10 will function properly to cause an alarm signal to be generated.

The terminal or foil block assembly 31, which may be manufactured from an insulative material such as plastic, is provided in order that a convenient solderless electrical interconnection is readily obtainable. The foil block assembly 31 includes a body portion or element 152 having a rear end or surface 154 adapted to be coupled to the pane 24 by an adhesive 156, and a front edge or surface 158 having a pair of spaced apart terminal fasteners 160 threadably extending within the body portion 152. The body portion 152 includes an inclined contacting or leading edge 162 having two groups of one or more seats or depressions 166 therein. As illustrated in FIG. 3, each conductive foil 26 is supported against the leading edge 162. A back edge 168 extends between the rear edge 154 and front edge 158. The body portion 152 includes a pair of space apart ends 170.

The body portion 152 further includes ribs 172 extending outwardly from the front edge 158. The ribs 172 extend to one side of each fastener 160 and form a channel for receiving a contact plate 174 associated with each fastener 160. The contact plate 174 includes an inclined tab 176 that corresponds to the angle of inclination of the contacting edge 162. The tab 176 may have projections 178 that are adapted to mate with the corresponding depressions 166. In this manner each foil 26 is sandwiched between the contacting edge 162 and a tab 176 to obtain electrical contact therebetween. The conducting elements 32 and 34 are secured beneath the head of each of the respective fasteners 160 in a conventional manner.

While we have shown and described a preferred embodiment of the present invention, it will be readily apparent to those skilled in the art that many modifications, change and improvements may be made herein without deviating from the present invention and the teachings hereof.

What is claimed is:

1. A switch assembly for interconnecting foil conductors on a window or other closure member within a burglar alarm system, said switch assembly comprising a first switch unit capable of being mounted on a closure member, a second switch unit adapted to be mounted on a fixed surface adjacent to said closure member, said first switch unit comprising a first housing having oppositely disposed sides and spaced apart surfaces intermediate said sides, said first housing having a slot extending between said oppositely disposed surfaces intermediate said sides, first contact means comprising a pair of spring biased slidable contact elements insulated from one another and extending through said slot at oppositely disposed ends thereof, and said contact elements each having a fixed end and a curved contact portion, conducting elements, coupling means for permitting removable positional securement of respective ones of said conducting elements between respective ones of said fixed ends and said foil conductors, said second switch unit comprising a second housing, second contact means fixedly secured to said second housing and comprising a pair of contact members insulated from one another, means for electrically connecting said second contact means within said burglar alarm system, and said first and second contact means being constructed for mutual engagement to provide a continuous circuit to said burglar alarm system inclusive of said foil conductors whereby movement of said closure member changes the relative position of said free ends of said contact elements relative to said contact members and upon disengagement thereof activates said burglar alarm system.

2. A switch assembly in accordance with claim 1, wherein the width of said contact elements is substantially equal to the width of said slot.

3. A switch assembly in accordance with claim 1, wherein said coupling means includes a fastener associated with each of said contact elements for concomitantly retaining each of said fixed ends of said contact elements and said conducting elements in place relative to one of said surfaces.

4. A switch assembly in accordance with claim 3, wherein each of said fasteners is in the form of a screw member threadably receivable in said first housing and extending through said contact element.

5. A switch assembly in accordance with claim 1, wherein said first housing includes a longitudinally extending upper groove on one of said surfaces intermediate said sides thereof, and said fixed end of each of said contact elements is adapted to extend within said upper groove and below said surface adjacent thereto.

6. A switch assembly in accordance with claim 5, wherein said first housing terminates in oppositely disposed ends, said slot extends substantially centrally between said oppositely disposed ends, and said upper groove extends substantially equidistantly on each side of said slot.

7. A switch assembly in accordance with claim 5, wherein said first housing includes a longitudinally extending lower groove on said opposite one of said surfaces intermediate said sides thereof, and said lower groove is dimensioned to receive a portion of each of said contact elements intermediate said fixed and said free ends when said free end of each of said contact elements is in full compressed engagement with said second switch unit and maintains a continuous electrical circuit path between 10 said first and second switch units.

8. A switch assembly in accordance with claim 1, including a metallic loop on said closure member connected in electrical series circuit with said first contact means whereby breaking said loop opens said series circuit to actuate said burglar alarm system.

9. A switch assembly in accordance with claim 1, wherein said first housing is fabricated from an insulative plastic material to prevent short circuiting of said contact elements mounted thereon.

10. A switch assembly in accordance with claim 1, wherein said second housing is fabricated from an insulative plastic material to prevent short circuiting of said contact members mounted thereon.

11. A switch assembly in accordance with claim 1, including first mounting means provided on said first housing, end said first mounting means comprising a pair of apertures extending between said sides for receiving a threaded member therethrough for securement of said first switch unit to said closure member.

12. A switch assembly in accordance with claim 1, including second mounting means provided on said second switch unit.

13. A switch assembly in accordance with claim 12, wherein said second mounting means includes a pair of apertures extending through said second housing.

14. A switch assembly in accordance with claim 1, wherein said second housing includes oppositely disposed sides and spaced apart surfaces intermediate said sides, and said sides and surfaces terminating in oppositely disposed ends.

15. A switch assembly in accordance with claim 14, wherein two pairs of said second mounting apertures are provided, one of said pairs of mounting apertures extending intermediate said sides, and the other of said pairs of mounting apertures extending intermediate said surfaces.

16. A switch assembly in accordance with claim 1, wherein each of said contact elements comprise a horizontally extending upper section forming said fixed end, an arcuate section integrally formed with said upper section at one end thereof and extending through said slot, a lower contoured portion integrally formed with and extending rearwardly from said arcuate section, and an upturned end portion integrally formed with said lower contoured portion and forming said curved contact portion.

17. A switch assembly in accordance with claim 16, wherein said arcuate section defines an arc substantially equal to the spacing between said surfaces.

18. A switch assembly in accordance with claim 16, wherein said contact elements are mounted in oppositely disposed directions with respect to one another.

19. A switch assembly in accordance with claim 1, wherein each of said contact members is disposed in a plane substantially parallel to said free ends of said contact elements, and each of said contact members includes a contoured outer end so as to provide for extended coupling of said pair of contact elements over the extended length of said second switch unit.

20. A switch assembly in accordance with claim 1, wherein each of said contact members include a contoured outer end so as to provide for extended coupling of said pair of contact elements over the extended length of said second switch unit.

21. A switch assembly for interconnecting foil conductors on a window or other closure member within a burglar alarm system, said switch assembly comprising a first switch unit capable of being mounted on a closure member, a second switch unit capable of being mounted on a fixed surface adjacent to said closure member, said first switch unit comprising a first housing having oppositely disposed sides and spaced apart surfaces intermediate said sides, said first housing having a slot extending between said oppositely disposed surfaces intermediate said sides, first contact means comprising a pair of spring biased slidable contact elements insulated from one another and extending through said slot at oppositely disposed ends thereof, each of said contact elements comprising a horizontally extending upper section forming a fixed end, an arcuate section integrally formed with said upper section at one end thereof and extending through said slot, a lower contoured portion integrally formed with and extending rearwardly from said arcuate section, an upturned end portion integrally formed with said lower contoured portion and forming a curved contact portion, conducting elements, coupling means for permitting removable positional securement of respective ones of said conducting elements between respective ones of said fixed ends of said contact elements and said foil conductors, first mounting means mounted on said first housing, said second switch unit comprising a second housing, second contact means fixedly secured to said second housing and comprising a pair of contact members disposed in insulated relationship with respect to one another, second mounting means provided on said second switch unit, means for electrically connecting said second contact means within said burglar alarm system, and said first and second contact means being constructed to engage one another to form a continuous electrical circuit path from said foil conductors to said burglar alarm system, whereby movement of said closure member changes the relative position of said curved contact portions of said contact elements relative to said contact members, and upon disengagement of said contact elements and said contact members said burglar alarm system is activated.

22. A switch assembly in accordance with claim 21, wherein the width of said contact elements is substantially equal to the width of said slot.

23. A switch assembly in accordance with claim 21, wherein said coupling means includes a fastener associated with each of said contact elements for concomitantly retaining each of said fixed ends of said contact elements and said conducting elements in place relative to one of said surfaces.

24. A switch assembly in accordance with claim 21, wherein said connecting means includes a pair of fasteners in the form of a screw member threadably receivable in said second housing and extending through each of said contact members secured to said second housing.

25. A switch assembly in accordance with claim 21, wherein said first housing terminates in oppositely disposed ends, said first housing also including a longitudinally extending upper groove on one of said surfaces intermediate said sides thereof, said fixed end of each of said contact elements being capable of extending within said upper groove, said slot extending substantially centrally between said oppositely disposed ends, said upper groove extending substantially equidistantly on each side of said slot, said first housing including a longitudinally extending lower groove on said opposite one of said surfaces intermediate said sides thereof, and said lower groove being constructed to receive therein a portion of each of said contact elements intermediate said fixed and said free ends when said free end of each of said contact elements in in compressed engagement with said second switch unit and maintains a continuous electrical circuit path between said first and second switch units.

26. A switch assembly in accordance with claim 25, wherein said arcuate section defines an arc substantially equal to the spacing between said surfaces, and said contact elements are mounted in oppositely disposed directions with respect to one another.

27. A switch assembly in accordance with claim 21, wherein said first and second housings are fabricated from an insulative plastic material to prevent short circuiting of said first and second contact means, respectively.

28. A switch assembly in accordance with claim 21, wherein said first mounting means comprises a pair of apertures extending between said sides for receiving a threadable member therethrough for securement of said first switch unit to said closure member, and said second mounting means includes at least one pair of apertures extending through said second housing for receiving a threadable member therethrough for securement of said second switch unit to said fixed surface.

29. A switch assembly in accordance with claim 21, wherein said contact elements are mounted in spaced longitudinal alignment with respect to one another, and said contact members are mounted in spaced longitudinal alignment with respect to one another.

30. A switch assembly in accordance with claim 21, wherein said oppositely disposed sides and said spaced apart surfaces of said first housing extend in subtantially spaced parallel relationship with respect to one another.

31. A switch assembly in accordance with claim 21, including a terminal assembly for interconnecting said foil conductors to said first switch unit.

32. A switch assembly in accordance with claim 31, wherein said terminal assembly comprises a body portion including a pair of spaced apart ends, a rear end and a front end intermediate said spaced apart ends, a contacting edge adjacent said front end and inclined relative to said rear end for receiving thereon at least one conductive foil, one or more depressions associated with said contacting edge, a contact plate having a tab that substantially corresponds to the angle of inclination of said contacting edge, said tab adapted to extend in overlapping relationship with said contacting edge for receiving one end of said conductive foil therebetween, and one or more projections extending downwardly from said tab in substantial alignment with said one or more depressions such that when said contact plate is fixedly secured to said body portion said conductive foil is coupled to said contact plate.

33. A switch assembly in accordance with claim 32, including a pair of ribs associated with and extending above said contacting edge so as to confine said conductive foil therebetween.

34. A switch assembly in accordance with claim 33, wherein two pairs of said ribs are provided on said contacting edge.

35. A switch assembly in accordance with claim 32, including an adhesive member to secure said rear end of said body portion to said window or other closure member.

* * * * *